United States Patent [19]

White

[11] Patent Number: 4,967,774

[45] Date of Patent: Nov. 6, 1990

[54] SMOKING ARTICLE WITH IMPROVED MEANS FOR RETAINING THE FUEL ELEMENT

[75] Inventor: Jackie L. White, Pfafftown, N.C.

[73] Assignee: R. J. Reynolds Tobacco Company, Winston-Salem, N.C.

[21] Appl. No.: 419,670

[22] Filed: Oct. 11, 1989

[51] Int. Cl.[5] ..... A24D 1/02; A24D 1/12; A24D 1/18

[52] U.S. Cl. ..... 131/365; 131/194; 131/360; 131/361; 131/362

[58] Field of Search ..... 131/365, 194, 360, 361, 131/362

[56] References Cited

U.S. PATENT DOCUMENTS

| | | | |
|---|---|---|---|
| 2,907,686 | 10/1959 | Siegel . | |
| 3,258,015 | 6/1966 | Ellis et al. . | |
| 3,358,094 | 12/1967 | Ellis et al. . | |
| 3,516,417 | 6/1970 | Moses . | |
| 4,079,742 | 3/1978 | Rainer et al. . | |
| 4,340,072 | 7/1982 | Bolt et al. . | |
| 4,474,191 | 10/1984 | Steiner . | |
| 4,708,151 | 11/1987 | Shelar . | |
| 4,714,082 | 12/1987 | Banerjee et al. . | |
| 4,756,318 | 7/1988 | Clearman et al. . | |
| 4,771,795 | 9/1988 | White et al. . | |
| 4,779,631 | 10/1988 | Durocher et al. . | |
| 4,793,365 | 12/1988 | Sensabaugh, Jr. et al. . | |
| 4,807,809 | 2/1989 | Pryor et al. . | |
| 4,827,950 | 5/1989 | Banerjee et al. . | |
| 4,854,331 | 8/1989 | Banerjee et al. | 131/194 |
| 4,903,714 | 2/1990 | Barnes et al. | 131/194 |

FOREIGN PATENT DOCUMENTS

| | | |
|---|---|---|
| 0212234 | 7/1986 | European Pat. Off. . |
| 236992 | 3/1987 | European Pat. Off. . |
| 0257230 | 6/1987 | European Pat. Off. . |
| 0277519 | 1/1988 | European Pat. Off. . |
| 0299272 | 6/1988 | European Pat. Off. . |
| 0304759 | 8/1988 | European Pat. Off. . |
| 0304766 | 8/1988 | European Pat. Off. . |
| 0305788 | 8/1988 | European Pat. Off. . |

*Primary Examiner*—V. Millin

*Attorney, Agent, or Firm*—Grover M. Myers; David G. Conlin

[57] ABSTRACT

A smoking article including a short, combustible, carbonaceous fuel element in a heat exchange relationship with a physically separate aerosol generating means, and a mouthend piece. Smoking articles of the present invention include means for retaining the fuel element in a predetermined position relative to other components of the smoking article. Preferred smoking articles of the present invention are capable of providing the user with the pleasures of smoking by heating but not burning tobacco.

18 Claims, 2 Drawing Sheets

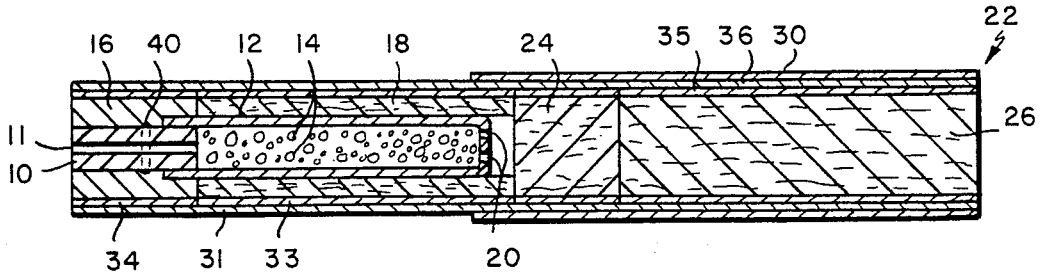
FIG. 1
FIG. 1A
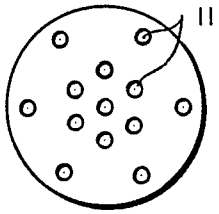
FIG. 2A
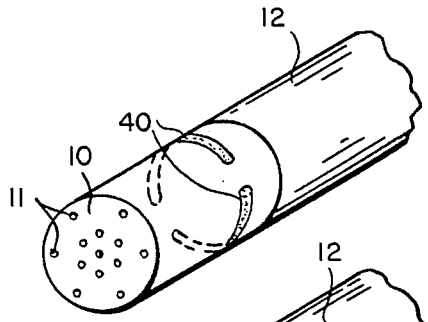
FIG. 2B
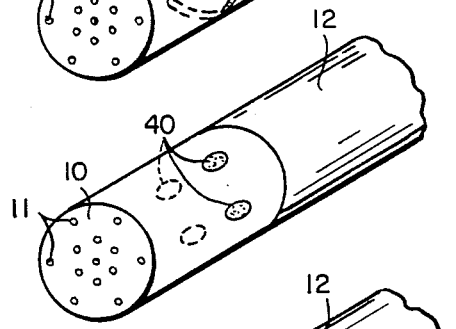
FIG. 2C
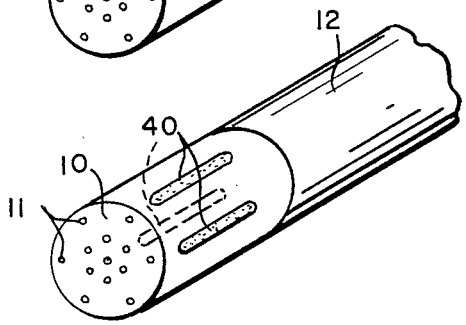

SMOKING ARTICLE WITH IMPROVED MEANS FOR RETAINING THE FUEL ELEMENT

BACKGROUND OF THE INVENTION

The present invention relates to smoking articles such as cigarettes and, in particular, to those smoking articles having a fuel element, a physically separate aerosol generating means, and a mouthend piece. Smoking articles of the present invention include means for retaining the fuel element in a predetermined position relative to other components of the smoking article. Preferred smoking articles of the present invention are capable of providing the user with the pleasures of smoking (e.g., smoking taste, feel, satisfaction, and the like), by heating but not burning tobacco.

Cigarettes, cigars and pipes are popular smoking articles which use tobacco in various forms. Many smoking products and smoking articles have been proposed through the years as improvements upon, or alternatives to, the various popular smoking articles.

Many tobacco substitute smoking materials have been proposed, and a substantial listing of such materials can be found in U.S. Pat. No. 4,079,742 to Rainer et al. Tobocco substitute smoking materials having the tradenames Cytrel and NSM were introduced in Europe during the 1970's as partial tobacco replacements, but did not realize any long-term commercial success.

Numerous references have proposed smoking articles which generate flavored vapor and/or visible aerosol. See, for example, U.S. Pat. No. 2,907,686 to Siegel; U.S. Pat. Nos. 3,258,015 and 3,356,094 to Ellis et al; U.S. Pat. No. 3,516,417 to Moses; U.S. Pat. No. 4,340,072 to Bolt and U.S. Pat. No. 4,474,191 to Steiner. However, despite decades of interest and effort, no one had successfully developed a smoking article which provided the sensations associated with cigarette, cigar or pipe smoking, without delivering considerable quantities of incomplete combustion and pyrolysis products.

Recently, however, in European Patent Publication Nos. 212,234 and 277,519; and U.S. Pat. Nos. 4,708,151; 4,714,082; 4,756,318 and 4,793,365; assigned to R.J. Reynolds Tobacco Co., there are described smoking articles which are capable of providing the sensations associated with cigarette and pipe smoking, without the necessity of burning tobacco and without delivering considerable quantities of incomplete combustion products. Such smoking articles employ an aerosol generating means, physically separate from and in a heat exchange relationship with a fuel element. The aerosol generating means normally includes tobacco in the form of tobacco extracts, tobacco flavor modifiers and tobacco flavoring agents and aerosol forming substances such as glycerin. It would be highly desirable to provide means which help retain the fuel element in a predetermined position in relation to other components of the smoking article both prior to and during smoking.

SUMMARY OF THE INVENTION

The present invention relates to smoking articles which include a combustible fuel element and a physically separate aerosol generating means in a heat exchange relationship with the fuel element. More specifically, the present invention relates to smoking articles which include means for retaining the fuel element in a predetermined position relative to the aerosol generating means and other components of the smoking article. In particular, it has been found that application of an inorganic adhesive material to the fuel element or to the supporting structures for the fuel element helps to retain the fuel element in place both prior to and during burning of the fuel. Preferably the inorganic adhesive is one which expands or swells, or otherwise undergoes chemical or physical change upon heating to bond or the otherwise hold the fuel element in place, without chemically or physically affecting the smoke or aerosol produced by the smoking article. Suitable organic adhesive materials include the silicates, such as sodium silicate, potassium silicate, and the like.

Preferred smoking articles of the present invention employ a short, carbonaceous fuel element having a length less than about 30 mm, and an aerosol generating means longitudinally disposed behind the fuel element (i.e., towards the mouthend of the smoking article relative to the fuel element). Normally, the aerosol generating means is in a conductive heat exchange relationship with the fuel element. A resilient insulating member, normally at least about 0.5 mm thick, preferably circumscribes the periphery of the fuel element. Preferred smoking articles also include a mouthend piece, normally having the form of a filter plug segment. Preferred filter segments exhibit low filtration efficiencies so as to minimize interference with the passage of aerosol from the aerosol generating means to the mouth of the smoker during draw (i.e., upon use). Also preferred are smoking articles which employ a segment of flavor-containing material, such as a gathered or pleated tobacco paper or menthol-containing pleated carbon filled sheet between the aerosol generating means and the filter segment.

Preferred cigarette smoking articles of the present invention include a roll or charge of tobacco, normally in cut filler form, wrapper in a wrapping material such as paper, thereby forming a tobacco rod. The tobacco can be in a processed form, such as volume expanded cut filler or aqueously extracted/volume expanded cut filler. Preferably the aerosol generating means comprises a container or housing which is preferably heat conductive or otherwise heat resistant and located in a passage which extends longitudinally through the tobacco rod. The short fuel element is located at one end of the container, and the mouthend piece is located at the other end of the container. In accordance with the present invention an inorganic material such as sodium silicate is preferably applied to the fuel element, preferably at or near the container. The container contains one or more aerosol forming materials. Such aerosol forming materials can include tobacco such as tobacco dust, spray dried tobacco extracts or tobacco essences; and tobacco flavoring agents such as sugars, licorice and cocoa. Other aerosol forming materials also include polyhydric alcohols, such as glycerin, propylene glycol and triethylene glycol, which vaporize to produce a visible, "smoke-like" aerosol. The aerosol forming materials within the container typically are carried by a substrate such as alumina beads or a fibrous carbon material.

The use of an inorganic adhesive material on the fuel element in combination with the previously described smoking articles provides the skilled artisan with an efficient and effective method for retaining the fuel element in a predetermined position relative to the other components of the smoking article. In particular, heat generated by the burning fuel element of the smoking article during use causes the inorganic adhesive material to undergo physical and/or chemical changes which bind the burning fuel element to its surrounding component(s), e.g., the resilient insulating material which circumscribes the periphery of the fuel element.

The smoking articles of the present invention are described in greater detail in the accompanying drawings and the detailed description of the invention which follows.

BRIEF DESCRIPTION OF THE DRAWINGS

FIG. 1 is a longitudinal, sectional view of the preferred cigarette representative of the present invention; and FIG. 1A is a sectional views of one preferred fuel element passageway configuration useful in the preferred smoking articles.

FIGS. 2A–2C illustrate various patterns for applying the inorganic adhesive material to the fuel element depicted in FIG. 1A.

DETAILED DESCRIPTION OF THE PREFERRED EMBODIMENTS

Referring to FIG. 1, there is a cigarette which includes a small, carbonaceous fuel element 10 having a plurality of passageways 11 therethrough, preferably arranged as shown in FIG. 1A. The fuel element 10 is shown surrounded or circumscribed by a resilient jacket of insulating fibers 16, such as glass fibers.

A heat resistant housing or container 12 is longitudinally disposed behind the fuel element 10. The container 12 normally is manufactured from a heat conductive material such as aluminum.

Within container 12 is positioned a granular or particulate substrate 14, although other forms of substrates, such as heat resistant carbon fibers and densified tobacco pellets can be employed. The substrate 14 acts as a carrier for the aerosol forming substances which includes substances such as glycerin, tobacco flavorings agents, and tobacco in forms such as tobacco dust, finely divided tobacco laminae and tobacco extracts. The container 12 has an open end into which the fuel element 10 is inserted, and a closed end having one or more slit-like passageways or slots 20 forming openings therein. Passageways 20 are dimensioned to contain the substrate within the container, while permitting the passage of vaporized aerosol forming materials therethrough.

The fuel element is provide with an inorganic adhesive material 40, applied to the fuel element as illustrated, for example, in FIGS. 2A–2C, in order to help retain the fuel element in its position relative to the other components of the cigarette.

The inorganic adhesive material may be applied to the fuel element in a number of patterns. For example, it may be applied longitudinally or circumferentially to the fuel element either in solid lines or broken lines. It may also be applied as one or more dots. FIGS. 2A–2C illustrate several preferred patterns which may be used in practicing the present invention. The most preferred patterns are the two equispaced arcs which together circumscribe about two-thirds of the fuel element illustrated in FIG. 2A, and the four equispaced dots circumscribing the fuel element illustrated in FIG. 2B. Another embodiment illustrated in FIG. 2C shows the adhesive material applied in one or more lines from the front to back of the fuel. For the preferred embodiments shown in FIGS. 2A and 2B, the inorganic adhesive material is preferably applied at or near the container which contains the inserted fuel element. Preferably, the inorganic adhesive material is applied within about 3.0 mm of the container, preferably between about 0.5 and 2.0 mm.

The container 12 is positioned within, and circumscribed by, a roll of tobacco 18. Normally, the roll of tobacco is a charge of cut filler; although other forms of tobacco, such as extruded tobacco, can be employed. Typically, cut filler includes strands or shreds of tobacco laminate, strands or shreds of reconstituted tabocco, volume expanded strands or shreds of tobacco laminate and processed (e.g., aqueously extracted) tobacco laminate, processed tobacco stems, and the like, as well as blends thereof. The roll of tobacco 18 is circumscribed by wrapping material 33, such as cigarette paper, thereby forming a tobacco rod having the container 12 located therein.

The fuel element 10 which is peripherally circumscribed by the insulating jacket 16 and the tobacco rod are overwrapped by a circumscribing outer wrapper 31. Other wrappers which may be used are described in U.S. Pat. No. 4,779,631 to Durocher et al, which is incorporated herein by reference. See, also, European Patent Application No. 304766.

At the mouth end of the tobacco rod is located a mouthend piece 22. The mouthend piece normally includes (i) a segment of flavor-containing material 24 (e.g., tobacco paper or carbon filled sheet bearing a flavor such as menthol) wrapped in a paper wrapper 35; and (ii) a filter plug including a segment of filter material 26 (e.g., a pleated or gathered sheet of non-woven thermoplatic fibers) wrapped in a paper wrapper 32. An apparatus suitable for manufacturing such segments from respective webs of sheet-like materials is described in U.S. Pat. No. 4,807,809 to Pryor et al, which is incorporated herein by reference. See, also, European Patent Application No. 304759. The two segments are overwrapped and maintained in place by circumscribing paper 36.

The segment which includes the fuel element and tobacco rod is positioned in an abutting end-to-end relationship with the mouthend piece, and two segments are held in place by tipping material 30 which circumscribes the mouthend piece as well as an adjacent region of the tobacco rod.

Smoking articles in which the present invention is useful and various components thereof, are described in greater detail in U.S. Pat. No. 4,771,795 to White et al.; U.S. Pat. No. 4,714,082 to Banerjee et al.; U.S. Pat. No. 4,756,318 to Clearman et al.; U.S. Pat. No. 4,793,365 to Sensabaugh et al. and U.S. Pat. No. 4,827,950 to Banerjee et al. and in European Patent Application Nos. 212,234; 277,519; and 305,788, all of which are incorporated herein by reference. Methods for making suitable fuel elements are set forth in European Patent Publication No. 236,992, which is incorporated herein by reference. Apparatus suitable for assembling preferred substrate-filled cartridges having fuel elements inserted into one end thereof is described in European Patent Publication No. 257,230, which is incorporated herein by reference. Apparatus suitable for manufacturing preferred smoking articles of the present invention are described in European Patent Publication Nos. 299,260 and 299,272, which are incorporated herein by reference.

In general, inorganic adhesive materials useful in practicing the present invention include those which undergo physical and/or chemical change upon heating so as to help retain the fuel element in a predetermined position relative to other components of the smoking article. The preferred inorganic adhesive material include sodium silicate (water glass), potassium silicate, and the like. Other soluble sodium silicates (or potassium silicates) such as sodium metasilicate anhydrous, sodium metasilicate pentahydrate, sodium sesquisilicate and sodium orthosilicate may also be employed as the inorganic adhesive material. Sodium silicate is most preferred.

The viscosity of the inorganic adhesive material may range broadly and depends on a number of factors including density. In general, the viscosity in centipoises for the preferred inorganic adhesive material, sodium silicate, is between about 50 and 70,000, preferably between about 60 and 10,000, and most preferably between about 100 and 3,000. Inorganic adhesive materials having a viscosity between about 100 and 3,000 facilitate application of the inorganic adhesive material to the fuel element and/or other components of the smoking article which contact the fuel element.

For the preferred inorganic adhesive materials such as sodium silicate, potassium silicate, and the like, the weight ratio of $SiO_2$ to $Na_2O$ or $K_2O$ may range broadly depending on a number of factors including its ability to swell upon heating, the amount of adhesiveness required, and the like. In general, the weight ratio of $SiO_2$ to $Na_2O$ is between about 1.60 and 3.25, preferably between about 2.00 and 3.22. Without wishing to be bound by theory, it is believed that the lower the ratio of silicate to the sodium component, the greater adhesion there is between the fuel element and its surrounding components. This is believed to be due, at least in part to the greater expansion of the sodium silicate which occurs during smoking at these lower preferred ratios.

The density of the preferred sodium or potassium silicate is generally greater than about 1.0 g/cm$^3$, preferably greater than about 1.3 g/cm$^3$.

The amount of inorganic adhesive material used in practicing the present invention may vary depending on a number of factors including solids content. In general, for the preferred sodium silicate, the amount is between about 0.1 and 10 mg, preferably between about 0.1 and 5.0 mg, and most preferably between about 0.7 and 3.0 mg.

The inorganic adhesive material may be applied to one or more components of the smoking article including the fuel element, the resilient jacket of insulating material which circumscribes the fuel element, and the heat resistant container into which the fuel element is inserted. It is preferable, however, to apply the inorganic adhesive material to the fuel element at or near the container containing the inserted fuel element. During smoking, it is believed that heat generated from the burning fuel element during the initial puffs causes the adhesive material to expand by undergoing chemical and/or physical changes and to adhere to the fuel and surrounding structures. This helps to retain the fuel element in place in relation to other components during smoking.

The following examples are provided in order to further illustrate various embodiments of the invention but should not be construed as limiting the scope thereof. Unless otherwise noted, all parts and percentages are by weight.

EXAMPLE 1

Cigarettes of the type illustrated in FIG. 1 are manufactured in the following manner:

Fuel Source Preparation

A generally cylindrical fuel element 10 mm long and 4.5 mm in diameter, and having an apparent (bulk) density of about 0.86 g/cc is prepared from about 79 parts hardwood pulp carbon, about 10 parts Raven J Lampblack unactivated carbon having an average particle size of 0.2 micrometers in diameter, 10 parts Hercules 7HF SCMC binder, and 1 part potassium carbonate.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 4 to about 6 microns in diameter.

The finely powdered hardwood carbon is admixed with the lampblack carbon, the sodium carboxymethyl cellulose binder, the potassium carbonate, and sufficient water to provide a mixture having a stiff, dough-like paste form.

Fuel elements are extruded using a ram extruder from the paste so as to have 7 central passageways, each of about 0.21 inch in diameter, and 6 peripheral passageways, each of about 0.01 inch in diameter. The configuration of the passageways or holes which extend longitudinally through the fuel element is shown in FIG. 1A. The inner web thickness, or spacing between the central passageways, is about 0.008 inch; and the average outer web thickness, or spacing between the periphery of the fuel element and the peripheral passageways, is about 0.019 inch. The resulting extrudate is dried in air to provide a resilient extrudate, and the extrudate is cut into, 10 ml lengths, thereby providing fuel elements.

The extruded fuel elements are preferably baked-out under nitrogen atmosphere for a 40 minute period so as to reach a temperature of at least 900° C. during the period.

Spray Dried Tobacco Extract

A blend of aged flue-cured tobacco is ground to a dust and extracted with water in a stainless steel tank at a concentration of about 1 to about 1.5 pounds tobacco per gallon of water. The extraction is conducted using mechanical agitation at ambient temperature over a period of about 1 to about 3 hours. The tobacco/water admixture then is centrifuged to remove suspended solids. The aqueous tobacco extract is concentrated in a thin film evaporator to a concentration of about 30 percent dissolved tobacco solids. The concentrated aqueous extract then is spray dried by continuously pumping the aqueous solution to an Anhydro Size No. 1 Spray Dryer. The dried powder is collected at the outlet of the spray dryer. The inlet temperature of the spray dryer is about 215° C., and the outlet temperature is about 83° C. The spray dried powder has a moisture content of about 6 to about 8 percent.

Alumina Substrate

Alpha alumina beads are available as D02 Sintered Alpha Alumina from W.R. Grace & Co. The beads are about 97 percent alpha alumina, and have a surface area of about 4 to about 8 $m^2/g$ as determined using the BET method. The beads have a size from −14 to +20 mesh (U.S.).

Preparation of Flavored Substrate

The sintered alumina was combined, in a two-step process, with the ingredients shown below in the indicated proportions:

| | |
|---|---|
| Alumina | 68.11% |
| Glycerin | 19.50% |
| Spray Dried Extract | 8.19% |
| High Fructose Corn Syrup | 3.60% |
| Abstract of Cocoa | 0.60% |

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 weight percent. In the second step, this treated alumina was mixed with a combination of the other listed ingredients until the liquid was substantially absorbed within the alumina carrier.

Cartridge Assembly

A hollow metal container is manufactured from aluminum using a metal drawing process. The container has a length of about 30 mm, outer diameter of about 4.5 mm, and an inner diameter of about 4.3 mm. One end of the container is open; and the other end is sealed, except for two slot-like openings, which are about 0.65 mm by 3.45 mm in size and spaced about 1.14 mm apart.

About 340 mg of the treated alumina substrate is loaded into the container. Then, the fuel element is inserted into the open end of the container to a depth of about 4 mm. As such, the fuel element extends about 7 mm beyond the open end of the container. Approximately 2.5 mg of sodium silicate having a viscosity of about 2100 centipoise, a density of about 1.55 $g/cm^3$ (at 20° C.) and a $SiO_2$ to $Na_2O$ ratio of about 2.40 (obtained from PQ Inc. of Valley Forge, Pa., under the name RU) was applied to the fuel element as four spots, spaced 90° around the circumference of the fuel, directly in front of the aluminum capsule.

Insulating Jacket

The assembled fuel element—capsule combination is overwrapped, at the fuel element end, with a 10 mm long glass fiber jacket. The glass fiber jacket is Owens-Corning 637 glass having a 3 percent pectin binder. The resulting diameter of the glass fiber jacketed fuel element is about 7.5 mm. The glass jacket is overwrapped with an innerwrap paper material designated as P78-63-5 from Kimberly-Clark Corp.

Tobacco Roll

A tobacco roll consisting of volume expanded Burley tobacco cut filler is wrapped in a paper designated as P1487-125 from Kimberly-Clark Corp., thereby forming a tobacco rod having a diameter of about 7.5 mm and a length of about 22 mm. Insertion of a probe into one end of the tobacco rod provides a longitudinal passageway of about 4.5 mm diameter through the tobacco rod.

Frontend Assembly

The container portion of the insulated cartridge assembly is inserted into the passageway in the tobacco roll until the glass fiber jacket abuts one end of the tobacco rod. The overwrapped glass fiber section and the tobacco rod then are joined together by a paper overwrap designated as P1768-182 from Kimberly-Clark Corp., which circumscribes the length of the overwrapped glass fiber section as well as the length of the tobacco rod. The length of the resulting front end assembly is about 48 mm.

Mouthend Piece

A mouthend piece includes a 10 mm long cylindrical segment of a gathered tobacco paper and a 30 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 to Pryor et al.

The first segment is about 7.5 mm in diameter, and is provided from a gathered web of tobacco paper available as P1440B from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as P100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as P850-186-2 from Kimberly-Clark Corp. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthpiece and a 5 mm length of the front end assembly adjacent the mouthend piece with tipping paper available as 30637-801-12001 from Ecusta Corporation.

For use, the smoker lights the fuel element with a cigarette lighter and the fuel element burns. The smoker inserts the mouthend of the cigarette into his/her lips, and draws on the cigarette. A visible aerosol having tobacco flavor is drawn into the mouth of the smoker.

On examination, it was found that the $Na_2O$ expanded into the surrounding insulating jacket, thus helping to retain the fuel element during smoking.

EXAMPLE II A cigarette of the type described in Example I is provided except that the inorganic adhesive material, a type M sodium silicate having a viscosity of about 780 centipoises and a density of about 1.50 g/cm$^3$ and an $SiO_2$ to $Na_2O$ ratio of about 2.58 (PQ Inc.) was applied to the fuel in a pattern of two arcs directly opposite each other and encompassing about 120° each. When smoked by machine at 50–30. conditions no fuels fell out. The cigarettes were tapped by an air stroke cylinder directly in front of the juncture of the tipping paper with rod paper.

Potassium silicates Kasil #1 and Kasil #2, (PQ Inc.) were both tested as described above, and again these fuels did not fall out.

A mixture of sodium silicate type D and colloidal silica 9950 (both from the Nyacol Division of PQ), 50/50 by weight was tested as above, and fuels did not fall out.

What is claimed is:

1. A smoking article comprising:

(a) a fuel element;

(b) a physically separate aerosol generating means including at least one aerosol forming material;

(c) an insulating member which circumscribes at least a portion of the fuel element; and (d) an inorganic adhesive material which helps to retain the fuel element in a predetermined position relative to the aerosol generating means and insulating member.

2. The smoking article of claim 1, wherein the inorganic adhesive material expands upon heating to retain the fuel element in a predetermined position.

3. The smoking article of claim 1, wherein the inorganic adhesive material is selected from the group of sodium silicate, potassium silicate, colloidal silica, or mixtures thereof.

4. The smoking article of claim 3, wherein the viscosity of the inorganic adhesive material is between about 50 and 70,000 centipoise.

5. The smoking article of claim 3, wherein the viscosity of the inorganic adhesive material is between about 60 and 10,000 centipoise.

6. The smoking article of claim 3, wherein the viscosity of the inorganic adhesive material is between about 100 and 3,000 centipoise.

7. The smoking article of claim 3, wherein the density of the inorganic adhesive material is greater than about 1.0 g/cc$_3$.

8. The smoking article of claim 3, wherein the density of the inorganic adhesive material is greater than about 1.3 g/cc$_3$.

9. The smoking article of claim 3, wherein the inorganic adhesive material is located on the periphery of the fuel element adjacent to the aerosol generating means.

10. The smoking article of claim 9, wherein the amount of inorganic adhesive material is between about 0.01 and 10 mg.

11. The smoking article of claim 9, wherein the amount of inorganic adhesive material is between about 0.1 and 5 mg.

12. The smoking article of claim 9, wherein the amount of inorganic adhesive material is between about 0.2 and 3 mg.

13. The smoking article of claim 1 or 8, wherein the fuel element is carbonaceous.

14. The smoking article of claim 1 or 8, wherein the inorganic adhesive material is applied to the fuel as four equally spaced dots around the periphery of the fuel adjacent the aerosol generating means.

15. The smoking article of claim 1 or 8, wherein the inorganic adhesive material is applied to the fuel as two equally spaced arcs around the periphery of the fuel adjacent the aerosol generating means.

16. The smoking article of claim 1, wherein the inorganic adhesive material comprises sodium silicate.

17. The smoking article of claim 16, wherein the weight ratio of silica to sodium is between about 1.00 and 3.25.

18. The smoking article of claim 4, wherein the weight ratio of silica to sodium is between about 2.00 and 3.22.

* * * * *

UNITED STATES PATENT AND TRADEMARK OFFICE

CERTIFICATE OF CORRECTION

PATENT NO. : 4,967,774

DATED : November 6, 1990

INVENTOR(S) : Jackie L. White

It is certified that error appears in the above—identified patent and that said Letters Patent is hereby corrected as shown below:

Column 10, line 41, "claim 4" should be --claim 16--.

Signed and Sealed this

Twenty-first Day of April, 1992

*Attest:*

HARRY F. MANBECK, JR.

*Attesting Officer*

*Commissioner of Patents and Trademarks*